US012303731B1

(12) United States Patent
Yu

(10) Patent No.: US 12,303,731 B1
(45) Date of Patent: May 20, 2025

(54) WALL-MOUNTED FLY WALL RACK

(71) Applicant: SHIHE INC, Loveland, CO (US)

(72) Inventor: Wei Yu, Loveland, CO (US)

( * ) Notice: Subject to any disclaimer, the term of this patent is extended or adjusted under 35 U.S.C. 154(b) by 0 days.

(21) Appl. No.: 18/882,130

(22) Filed: Sep. 11, 2024

(51) Int. Cl.

| | |
|---|---|
| ***A63B 21/062*** | (2006.01) |
| ***A63B 21/00*** | (2006.01) |
| ***A63B 21/16*** | (2006.01) |
| ***A63B 23/035*** | (2006.01) |
| *A63B 71/00* | (2006.01) |

(52) U.S. Cl.
CPC ..... *A63B 21/0628* (2015.10); *A63B 21/156* (2013.01); *A63B 21/169* (2015.10); *A63B 21/4027* (2015.10); *A63B 23/03516* (2013.01); *A63B 21/00047* (2013.01); *A63B 71/0036* (2013.01)

(58) Field of Classification Search
CPC ..... A63B 21/156; A63B 21/0628; A63B 21/4027; A63B 21/00047; A63B 21/169; A63B 21/062; A63B 21/0624; A63B 21/0626; A63B 21/0632; A63B 23/03516; A63B 71/0036; Y10T 403/32319; Y10T 403/32327
See application file for complete search history.

(56) References Cited

U.S. PATENT DOCUMENTS

| | | | | |
|---|---|---|---|---|
| 10,226,661 | B2 * | 3/2019 | Henniger | A63B 21/4035 |
| 10,953,301 | B2 * | 3/2021 | Brasch | A63B 23/03525 |
| 11,058,936 | B1 * | 7/2021 | Brasch | A63B 23/1218 |
| 11,260,261 | B2 * | 3/2022 | Henniger | A63B 21/0552 |
| 11,278,757 | B2 * | 3/2022 | Schmidt | A63B 23/0405 |
| 11,446,535 | B1 * | 9/2022 | Iverson | A63B 17/00 |
| D1,001,216 | S * | 10/2023 | Yang | D21/686 |
| 11,878,205 | B2 * | 1/2024 | Campbell | A63B 21/156 |
| 2002/0091043 | A1 * | 7/2002 | Rexach | A63B 21/0628 482/99 |
| 2007/0042878 | A1 * | 2/2007 | Lundquist | A63B 23/12 482/99 |
| 2009/0181833 | A1 * | 7/2009 | Cassidy | A63B 21/156 482/92 |

FOREIGN PATENT DOCUMENTS

| | | | | |
|---|---|---|---|---|
| WO | WO-2009003280 | A1 * | 1/2009 | A63B 21/0628 |

* cited by examiner

*Primary Examiner* — Megan Anderson
(74) *Attorney, Agent, or Firm* — Hawaii Patent Services; Nathaniel K. Fedde; Kenton N. Fedde

(57) ABSTRACT

A wall-mounted fly wall rack, which can be installed on a wall, comprises a rack body, a pulley assembly and a counterweight mechanism arranged on the rack body, wherein the rack body comprises a fixed frame and at least two movable frames; an adjustable locking mechanism is arranged between the movable frames and the fixed frame and is horizontally rotatably connected in a limited angle range; the adjustable locking mechanism comprises a pivot arm and a fixed arm; the movable frame is connected with the pivot arm, and the fixed frame is connected with the fixed arm.

13 Claims, 5 Drawing Sheets

WALL-MOUNTED FLY WALL RACK

TECHNICAL FIELD

The present disclosure relates to the technical field of sports equipment, in particular to a wall-mounted fly wall rack.

BACKGROUND

Smith machine and big and small bird exercisers are two kinds of fitness equipment that must be equipped in the exercise field and gym. However, having these two exercisers at the same time is too expensive and takes up too much space, which is not suitable for use in places with limited space such as home.

Although there are comprehensive exercisers combining Smith machine and small fly exerciser in the market, Smith machine and small fly exerciser are simply superimposed and combined together, and they do not have the function of mutual conversion. For this kind of machines, because they include all the necessary components of Smith machine and small fly exerciser, the manufacturing cost is not less than that of two separate machines, and they are huge.

The U.S. Pat. No. 933,387 discloses a "Slidable bar and carriage exercise assembly", which includes a Smith bar as a part of a multifunctional exerciser, and uses the Smith bar instead of free weight to use a selectable weight stack to resist movement resistance. U.S. patent Ser. No. 12/011,635 puts forward "Multifunctional comprehensive training device capable of being grasped stably", which can use the same set of selected barbells for Smith mechanism and cable mechanism through brackets, hangers and other parts.

However, when the exerciser disclosed above is doing flying exercise, the fitness equipment cannot adjust or switch the exercise posture and angle at will according to its own needs. At the same time, this fitness equipment is too bulky to be used in a smaller area than the traditional gym, and its manufacturing cost is not less than that of two separate exercise equipment.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

The present disclosure provides a wall-mounted fly wall rack, which can be installed on a wall, and includes a rack body and a pulley assembly and counterweight mechanism arranged on the rack body, wherein the rack body includes a fixed frame and at least two movable frames; an adjustable locking mechanism is arranged between the movable frames and the fixed frame; the adjustable locking mechanism includes a pivot arm and a fixed arm, the movable frame is connected with the pivot arm, and the fixed frame is connected with the fixed arm; and the pivot arm is provided with a locking member and a pivot shaft; the fixed arm is provided with a pivot disk and a mounting seat; the pivot arm is rotatably connected with the pivot disk through the pivot shaft; the pivot arm horizontally rotates within a limited angle range relative to the pivot disk; the pivot disk is provided with a plurality of fixing holes for insertion of the locking member along a rotation direction of the pivot arm, the pivot arm is selectively positioned at one of a plurality of rotation angles through the locking member, and the fixed arm is mounted on the wall through the mounting seat.

The present disclosure also provides a wall-mounted fly wall rack, which can be installed on a wall, and incudes a rack body and a pulley assembly and a counterweight mechanism arranged on the rack body; the rack body includes a fixed frame and movable frames; an adjustable locking mechanism is rotatably connected between the movable frame and the fixed frame and horizontally rotates within a limited angle range, and can be selectively positioned to any angle in the limited angle range through the adjustable locking mechanism; and there are at least two movable frames, and the two movable frames is able to horizontally rotate relative to the fixed frame to an open state or a storage state.

The present disclosure also provides a wall-mounted fly wall rack, which can be installed on a wall, and includes a rack body and a pulley assembly and counterweight mechanism arranged on the rack body; the rack body includes a fixed frame and movable frames; and there are at least two movable frames which are respectively horizontally and rotationally connected with the fixed frame within a limited angle range, and is selectively positioned at any angle in the limited angle range.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

Figure 1:
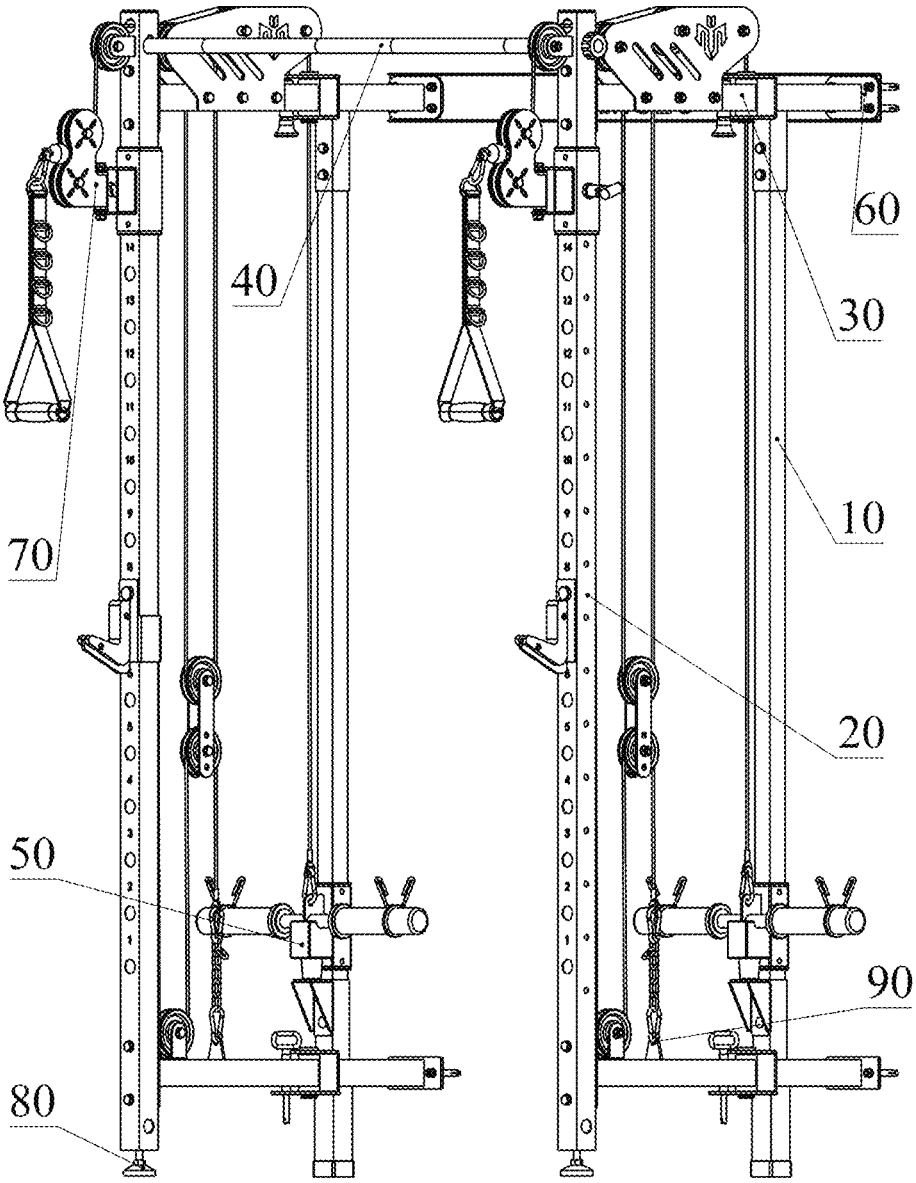
FIG. 1 is a schematic diagram of the overall structure of the wall-mounted fly wall rack of the present disclosure.
Figure 2:
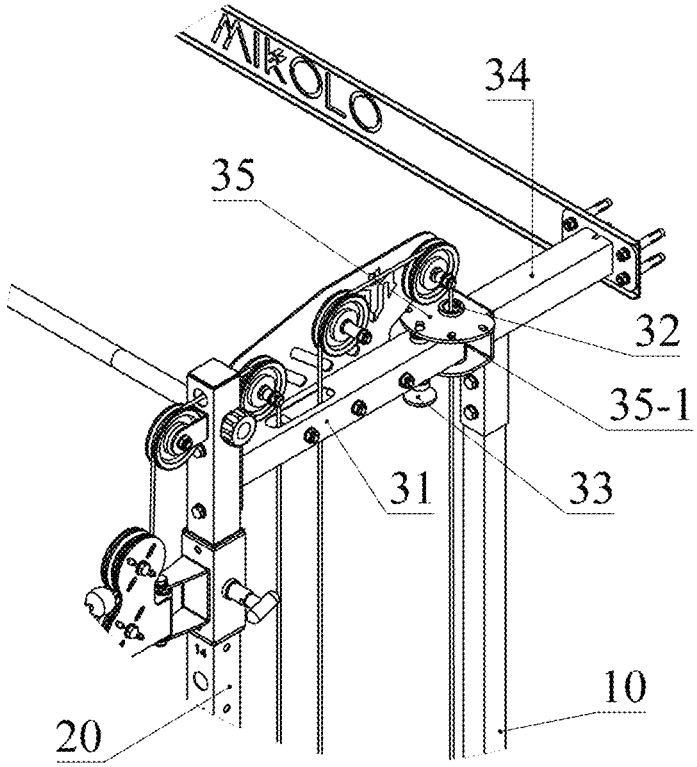
FIG. 2 is a partial schematic view of the adjustable locking mechanism of the present disclosure.

Reference signs: Fixed frame (10); Movable frame (20); Adjusting jack (20-1); Adjustable locking mechanism (30); Pivot arm (31); First pivot arm (31-A); Second pivot arm (31-B); Pivot shaft (32); Locking member (33); Elastic locking member (33-1); Fixed arm (34); Pivot disk (35); Fixing hole (35-1); Shell (36); Spring (37); A Locking post (38); Lock member handle (39); Connecting rod (40); Limit sheet (41); Limit groove (42); Fixing bolt (43); Counterweight mechanism (50); Counterweight lever (51); Limit member (52); Buffer pad (53); Mounting seat (60); Mounting plate (61); Mounting screw (62); Handle pulley block (70); Handle (71); Stopper (D); Pull rope (72); Sleeve (73); Adjusting pin (74); Pulley seat (75); First pulley (75-1); Second pulley (75-2); Adjusting pulley (76); First guide pulley (77); Second guide pulley (78); Pulley frame (79); Support foot (80); Adjusting nut (81); Adjusting bolt (82); Foot pad (83); Frame foot pad (84); Lock catch (90); Fixing rope (91).

DESCRIPTION OF EMBODIMENTS

In describing the preferred embodiments, specific terminology will be resorted to for the sake of clarity. It is to be understood that each specific term includes all technical equivalents which operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

As shown in FIGS. 1-9, the present disclosure provides a wall-mounted fly wall rack, which includes a rack body and a pulley assembly and counterweight mechanism 50 arranged on the rack body. The rack body includes a fixed frame 10 and movable frames 20, and an adjustable locking mechanism 30 is rotatably connected between the movable frame 20 and the fixed frame 10, and horizontally rotates within a limited angle range, and can be selectively positioned to any angle in the limited angle ranges through the adjustable locking mechanism 30. There are at least two movable frame 20, and the top ends of the two movable frames are provided with detachable connecting rods 40.

The adjustable locking mechanism 30 includes a pivot arm 31 and a fixed arm 34. The pivot arm 31 is provided with a locking member 33 and a pivot shaft 32, and the fixed arm 34 is provided with a pivot disk 35 and a mounting seat 60. The pivot arm 31 is rotatably connected with the pivot disk 35 through the pivot shaft 32; and the pivot arm 31 horizontally rotates relative to the pivot disk 35 within a limited angle range. The pivot disk 35 is provided with a plurality of fixing holes 35-1 for insertion of the locking member 33 along the rotation direction of the pivot arm 31. The pivot arm 31 can be selectively positioned at one of a plurality of rotation angles through the locking member 33, and the fixed arm 34 is installed on the wall through the mounting seat 60.

When the movable frame 20 horizontally rotates to the open state relative to the fixed frame 10, the pivot arm 31 of the movable frame 20 is arranged vertically to the wall along the length direction and locked by the locking member 33. At this time, the movable frame 20 is at a position of 90 degrees, and the connecting rod 40 is installed at the top ends of the two movable frames 20, providing certain stability to the two movable frames 20. When the movable frames 20 horizontally rotate to the storage state relative to the fixed frame 10, the connecting rod 40 is disengaged from the top ends of the two movable frames 20, the locking member 33 is unlocked from the locked state to the open state, and the pivot arms 31 of the movable frames 20 are arranged parallel to the wall along the length direction. At this time, the movable frames 20 are at the position of 0 or 180 degrees.

Figure 3:
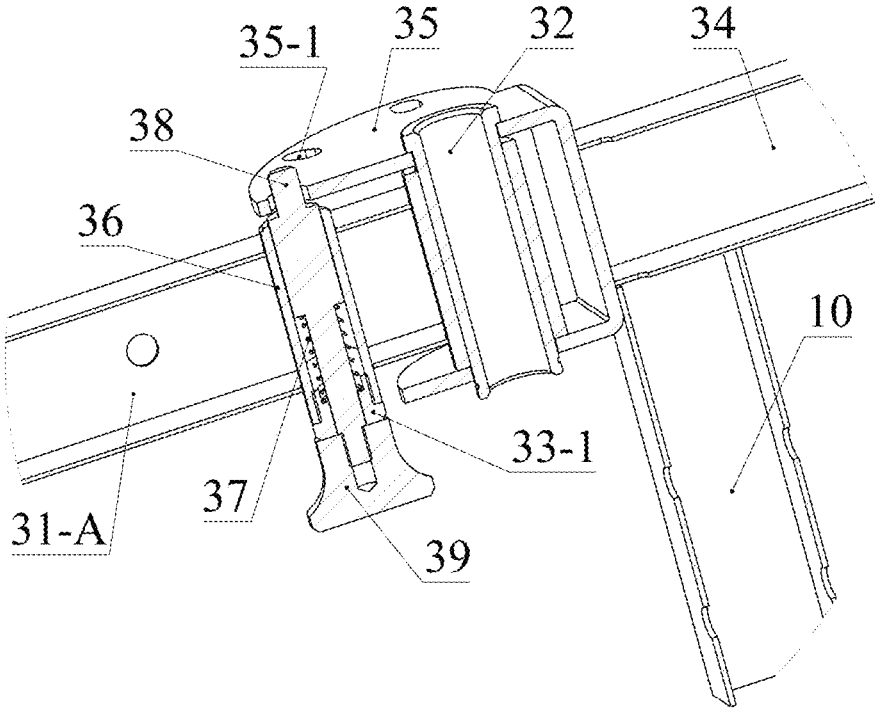
FIG. 3 is a sectional view of the elastic locking member of the present disclosure.
Figure 4:
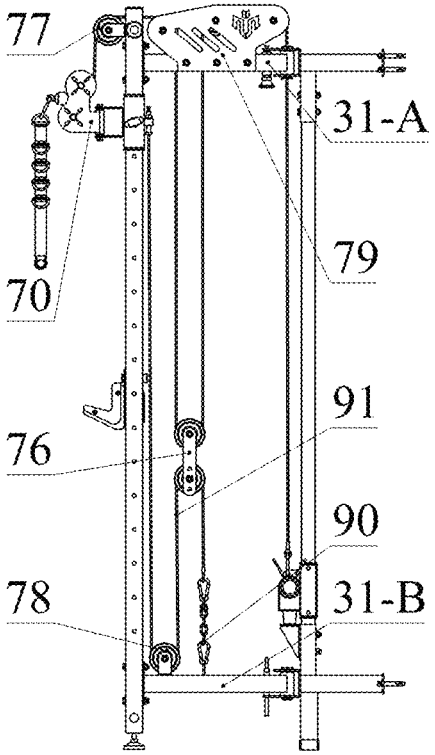
FIG. 4 is a schematic diagram of the overall structure of the pulley assembly of the present disclosure.

As shown in FIGS. 3 and 4, the pivot arm 31 includes a first pivot arm 31-A and a second pivot arm 31-B arranged up and down, and the locking member 33 of the first pivot arm 31-A and/or the second pivot arm 31-B is an elastic locking member 33-1. The elastic locking member 33-1 includes a shell 36, a spring 37 and a locking post 38 installed in the shell 36. The shell 36 is fixedly clamped on the pivot arm 31. One end of the locking post 38 near the pivot disk 35 passes through the shell 36 to be locked with the fixing hole 35-1, and the other end far away from the pivot disk 35 passes through the shell 36 to form a locking handle 39.

Specifically, the elastic locking member 33-1 of the pivot arm 31 is unlocked from the locked state, and then the pivot arm 31 of the movable frame 20 is rotated to an appropriate angle with respect to the pivot disk 35 of the fixed frame 10. At this time, the elastic locking member 33-1 automatically rebounds to lock the pivot arm 31 on the pivot disk 35, and the movable frame 20 forms an angle suitable for exercise with respect to the fixed frame 10, which is convenient for users to exercise. The locking member 33 of the second pivot arm 31-B is a pin member, and the pin member is inserted into the pivot disk 35, which can not only improve the stability of the whole structure when the movable frame 20 is locked relative to the fixed frame 10, but also facilitate the adjustment of the angle.

In this embodiment, the movable frame 20 is connected to the pivot arm 31 by bolts passing through the movable frame 20, and the fixed frame 10 is connected to the fixed arm 34 by bolts passing through the fixed frame 10. In some embodiments, not shown in the drawings, the connection between the movable frame 20 and the fixed frame 10 and the arm is not limited to bolt connection, but can be customized according to specific application requirements, such as threaded connection, welding or riveting. Compared with the other two connection methods, welding can make the connection between the two parts more firm and improve the strength of the overall structure.

Figure 5:
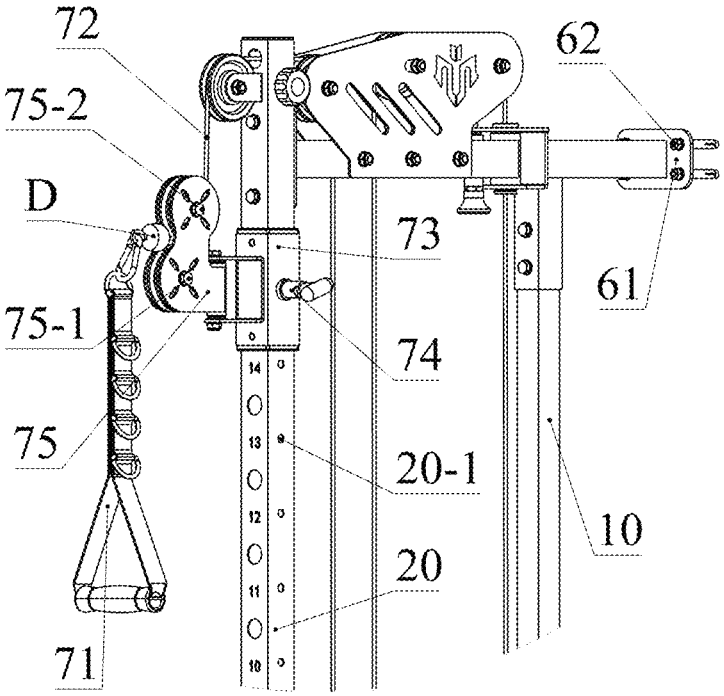
FIG. 5 is a schematic diagram of the overall structure of the handle pulley block of the present disclosure.

As shown in FIG. 5, the mounting seat 60 is arranged at one end of the fixed arm 34 far away from the pivot disk 35. The mounting seat 60 includes a mounting plate 61 and mounting screws 62. The fixed arm 34 is fixedly connected with the mounting plate 61. The mounting plate 61 is provided with a plurality of screw holes. The mounting plate 61 is generally plate-shaped, and the mounting screw 62 is preferably an expansion screw. Compared with other common screws, the expansion screw can provide good full bearing capacity and ensure the stability of the mounting seat 60 after installation. However, the expansion screw has certain requirements on the use environment and base material, and users can choose suitable installation screws according to their own needs and use environment.

Figure 7:
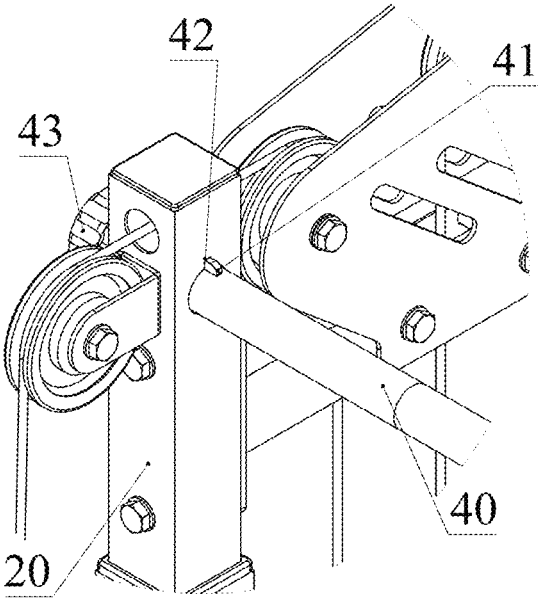
FIG. 7 is a schematic structural view of the connecting rod part of the present disclosure.

As shown in FIG. 7, one end of the connecting rod 40 is provided with a limit sheet 41 near the movable frame 20, and the movable frame 20 is provided with a limit groove 42 opposite to the limit sheet 41. Both ends of the connecting rod 40 are provided with fixing bolts 43, and the connecting rod 40 are detachably connected to the top end of the movable frame 20 through the fixing bolts 43, and the limit sheet 41 is clamped in the limit groove 42.

The existence of the connecting rod 40 can make the present disclosure have a pull-up exercise environment, and the existence of the limit sheet 41 makes the connecting rod 40 not rotate with the user's hard work when using the present disclosure for pull-ups; When a user wants to use the present disclosure to do fly exercise, the connecting rod 40 can be detached from the movable frame 20 by operating the fixing bolts 43, and then the movable frame 20 is operated to adjust it to a proper angle for exercise.

Specifically, firstly, two movable frames 20 are horizontally rotated and unfolded along the pivot disk, so that the length direction of the movable frames 20 is perpendicular to the wall and overhangs outward, and then the locking member 33 is inserted into the fixing hole 35-1 of the pivot disk 35, which plays a role in reliably positioning the movable frames 20, and ensures that the movable frames 20 are stably kept in a state of extending vertically parallel to the wall during unfolding. Then, the connecting rod 40 is connected with the top end of the movable frame 20, and both ends of the connecting rod 40 are fastened with fixing bolts 43 to prevent the connecting rod 40 from falling off. The existence of the fixing bolts 43 realizes the flexible disassembly and assembly between the connecting rod 40 and the movable frame 20.

In some embodiments, not shown in the figure, the connecting rod 40 may be a hollow circular tube or a hollow square tube. The hollow design can not only maintain a certain strength, but also reduce the material cost in production, and because it is hollow, the quality is also reduced to a certain extent, and the transportation cost can also be reduced. The square design can make the connecting rod 40 not rotate with the user's effort when the user performs pull-up exercise.

As shown in FIGS. 4 and 5, the pulley assembly includes a handle pulley block 70, an adjusting pulley 76, a first guide pulley 77 at the top of the movable frame 20, a pulley rack 79 at the top of the first pivot arm 31-A, and a second guide pulley 78 at the top of the second pivot arm 31-B and far away from the pivot shaft 32.

The handle pulley block 70 includes a handle 71, a pull rope 72, a sleeve 73 and a pulley seat 75. The handle pulley block 70 is slidably sleeved on the movable frame 20 through the sleeve 73, and a plurality of adjusting jacks 20-1 are arranged on the movable frame 20 in the vertical direction. The sleeve 73 can be selectively slidably positioned at any adjusting jack 20-1 position of the movable frame 20 through an adjusting pin 74. A first pulley 75-1 and a second pulley 75-2 are rotatably connected to the pulley seat 75, and a gap through which the pull rope 72 passes is reserved between the first pulley 75-1 and the second pulley 75-2;

The pull rope 72 extends from the handle 71, passes through the pulley assembly, the first guide pulley 77, the adjusting pulley 76, the pulley rack 79 and the pivot shaft 32 in turn, and is connected to the counterweight mechanism 50, the handle 71 is provided with a stopper D for limiting the retraction of the pull rope 72. The middle part of the second pivot arm 31-B is provided with a lock catch 90 and a fixing rope 91, and the fixing rope 91 extends from the lock catch 90 and sequentially passes through the adjusting pulley 76 and the second guide pulley 78 to be connected to the handle pulley block 70.

When the user uses the pulley assembly to exercise, the sleeve 73 is slidably positioned along the movable frame 20 to the appropriate position of the adjusting jack 20-1 by operating the adjusting pin 74. Because the adjusting pulley 76 is arranged in the pulley assembly, the pull rope 72 and the fixing rope 91 in the whole pulley assembly are always in a tight state, forming a labor-saving pulley block, which is more convenient for the user to exert force during exercise and improves the exercise effect.

In this embodiment, the first guide pulley 77 at the top of the movable frame 20 and the second guide pulley 78 at the top of the second pivot arm 31-B, which is far away from the pivot shaft 32, are connected by welding, which can make the connection between the two parts more firm. The pulley frame 79 at the top of the first pivot arm 31-A is connected by bolts, and there are three pulleys arranged side by side in the pulley frame 79, leaving a certain gap between the pulleys. In some embodiments, not shown, the guide pulley 77 and pulleys 75-1 and 75-2 can be made of rubber, plastic or other wear-resistant materials.

Figure 8:
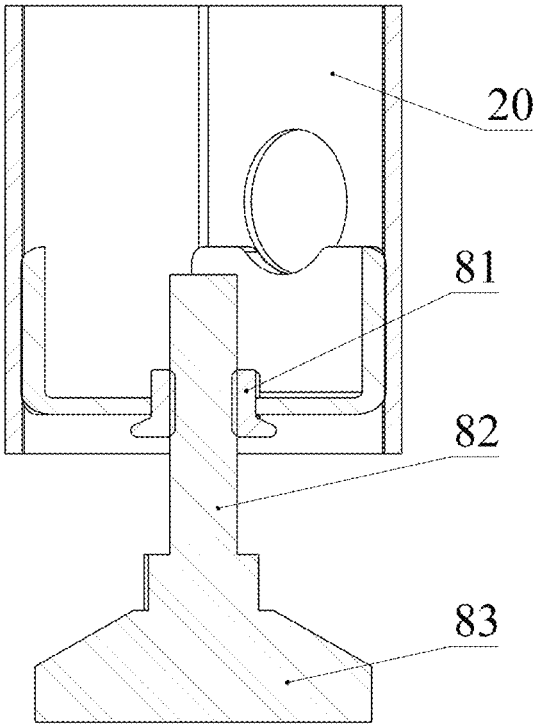
FIG. 8 is a schematic view of the structure of the support foot and the frame foot pad of the present disclosure.
Figure 9:
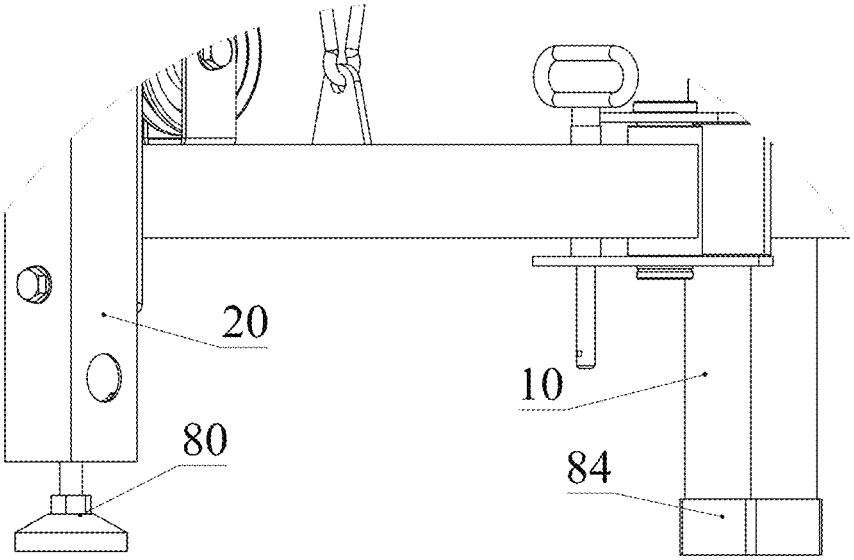
FIG. 9 is a cross-sectional view of the support foot of the present disclosure.

As shown in FIGS. 8 and 9, the bottom of the movable frame 20 is provided with feet 80 with an adjustable height, and the bottom of the fixed frame 10 is provided with a frame foot pad 84. The support foot 80 includes an adjusting nut 81, an adjusting bolt 82 and a foot pad 83. One end of the adjusting bolt 82 is fixedly connected with the foot pad 83, and the other end passes through the bottom of the movable frame 20 and is fastened by the adjusting nut 81, and the height of the support foot 80 is adjusted by the adjusting nut 81. Specifically, the movable frame 20 rotates pivotally and horizontally to a certain angle relative to the fixed frame 10 through the adjustable locking mechanism 30, and then the foot 80 is operated to contact the ground to provide support for the movable frame 20, which can improve the stability of the whole structure of the movable frame 20 to a certain extent. In some embodiments (not shown), the foot pad 83 and the frame foot pad 84 can be made of rubber or other wear-resistant materials.

Figure 6:
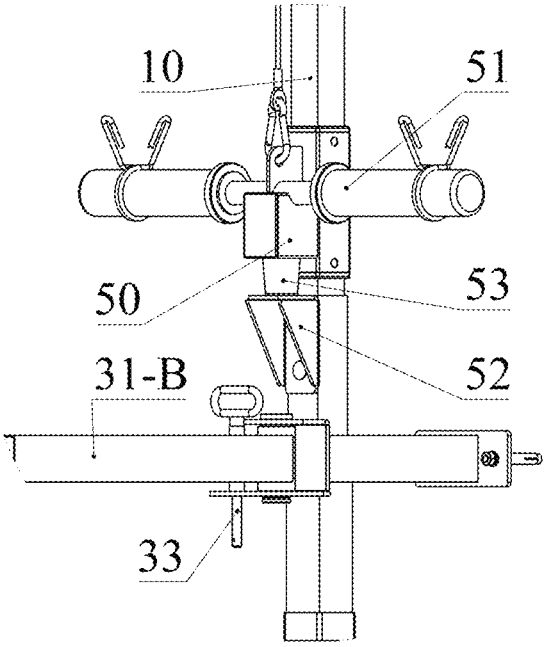
FIG. 6 is a schematic diagram of the overall structure of the counterweight mechanism of the present disclosure.

As shown in FIG. 6, the counterweight mechanism 50 includes a counterweight lever 51 and a limit member 52, wherein the counterweight lever 51 can be sleeved on the fixed frame 10 in a slidable manner up and down. The limit member 52 is fixedly connected to the fixed frame 10 and limits the counterweight lever 51. A buffer pad 53 is arranged at the joint position of the counterweight lever 51 and the limit member 52. The limit member 52 is arranged below the counterweight lever 51 to limit the stroke of the counterweight lever 51, so as to prevent the counterweight lever 51 from directly contacting the lower pivot disk 35 when it moves to the lower end of the fixed frame 10, thereby avoiding damage to it and prolonging the service life of the wall frame. In some embodiments (not shown), the buffer pad 53 on the counterweight lever 51 can be made of rubber or other materials with a damping effect.

The technical means disclosed in the scheme of the present invention are not limited to the technical means disclosed in the above embodiments, but also include the technical scheme composed of any combination of the above technical features. It should be pointed out that for those skilled in the art, several improvements and embellishments can be made without departing from the principle of the present invention, and these improvements and embellishments are also regarded as the protection scope of the present invention.

The invention has now been described in detail for the purposes of clarity and understanding. However, those skilled in the art will appreciate that certain changes and modifications may be practiced within the scope of the appended claims.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for ease of explanation only and are not meant to be limiting.

The various features and processes described above may be used independently of one another, or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

What is claimed is:

1. A wall-mounted fly wall rack configured to be installed on a wall, comprising a rack body and a pulley assembly and counterweight mechanism (50) arranged on the rack body, wherein the rack body comprises a fixed frame (10) and at least two movable frames (20); an adjustable locking mechanism (30) is arranged between a movable frame (20) of the at least two movable frames (20) and the fixed frame (10); the adjustable locking mechanism (30) comprises a pivot arm (31) and a fixed arm (34), the movable frame (20) is connected with the pivot arm (31), and the fixed frame (10) is connected with the fixed arm (34);

wherein the pivot arm (31) is provided with a locking member (33) and a pivot shaft (32); the fixed arm (34) is provided with a pivot disk (35) and a mounting seat (60); the pivot arm (31) is rotatably connected with the pivot disk (35) through the pivot shaft (32); the pivot arm (31) horizontally rotates within a limited angle range relative to the pivot disk (35); the pivot disk (35) is provided with a plurality of fixing holes (35-1) for insertion of the locking member (33) along a rotation direction of the pivot arm (31), the pivot arm (31) is selectively positioned at one of a plurality of rotation angles through the locking member (33), and the fixed arm (34) is mounted on the wall through the mounting seat (60);

wherein a connecting rod (40) is detachably connected between top ends of the at least two movable frames (20); and wherein the top end of the movable frame (20) is provided with a limit groove (42), a position of the connecting rod (40) close to the limit groove (42) is provided with a limit sheet (41) and is clamped in the limit groove (42); two ends of the connecting rod (40) are provided with fixing bolts (43), and the connecting rod (40) is detachably connected to the top end of the movable frame (20) through the fixing bolts (43).

2. The wall-mounted fly wall rack according to claim 1, wherein the pivot arm (31) comprises a first pivot arm (31-A) and a second pivot arm (31-B) arranged up and down; the locking member (33) of the first pivot arm (31-A) and/or the second pivot arm (31-B) is an elastic locking member; the elastic locking member (33-1) comprises a shell (36), a spring (37) and a locking post (38) installed in the shell (36); the shell (36) is fixedly clamped on the pivot arm (31), and one end of the locking post (38) close to the pivot disk (35) passes through the shell (36) to be inserted into a fixing hole of the plurality of fixing holes (35-1) for locking, and one end far from the pivot disk (35) passes through the shell (36) to form a locking member handle (39).

3. The wall-mounted fly wall rack according to claim 2, wherein the pulley assembly comprises a handle pulley block (70), an adjusting pulley (76), a first guide pulley (77), a second guide pulley (78) and a pulley frame (79); the first guide pulley (77) is arranged at the top of the movable frame (20); the second guide pulley (78) is arranged at the top of the second pivot arm (31-B) and far away from the pivot shaft (32); and the pulley frame (79) is arranged at the top of the first pivot arm (31-A).

4. The wall-mounted fly wall rack according to claim 3, wherein the handle pulley block (70) comprises a handle (71), a pull rope (72), a sleeve (73) and a pulley seat (75); the handle pulley block (70) is slidably sleeved on the movable frame (20) through the sleeve (73); the movable frame (20) is provided with a plurality of adjusting jacks (20-1) along the vertical direction, and the sleeve (73) is configured to be selectively positioned at any adjusting jack (20-1) of the plurality of adjusting jacks (20-1) in a sliding manner by an adjusting pin (74).

5. The wall-mounted fly wall rack according to claim 4, wherein the pulley assembly further comprises a first pulley (75-1) and a second pulley (75-2) rotatably connected to the pulley seat (75), and a gap between the first pulley (75-1) and the second pulley (75-2) through which the pull rope (72) is configured to be passed is reserved.

6. The wall-mounted fly wall rack according to claim 5, wherein the pull rope (72) extends from the handle (71) and passes through the pulley assembly, the first guide pulley (77), the adjusting pulley (76), the pulley frame (79) and the pivot shaft (32) in turn and is connected to the counterweight mechanism (50); and the handle (71) is provided with a stopper (D) for limiting the retraction of the pull rope (72).

7. The wall-mounted fly wall rack according to claim 1, wherein a bottom of the movable frame (20) is provided with a support foot (80) with an adjustable height, and the bottom of the fixed frame (10) is provided with a frame foot pad (84).

8. The wall-mounted fly wall rack according to claim 7, wherein the support foot (80) comprises an adjusting nut (81), an adjusting bolt (82) and a foot pad (83); one end of the adjusting bolt (82) is fixedly connected with the foot pad (83), and the other end passes through the bottom of the movable frame (20) and is fastened by the adjusting nut (81); and the height of the support foot (80) is adjusted by the adjusting nut (81).

9. The wall-mounted fly wall rack according to claim 1, wherein the movable frame (20) is able to horizontally rotate relative to the fixed frame (10) through the adjustable locking mechanism (30) at multiple angles of 0-180 degrees, and when the movable frame (20) is at 90 degrees, the movable frame is vertical relative to the fixed frame (10); and when the movable frame (20) is at 0 or 180 degrees, the movable frame (20) is parallel to the wall.

10. The wall-mounted fly wall rack according to claim 1, wherein the at least two movable frames (20) comprises a first movable frame and a second movable frame.

11. The wall-mounted fly wall rack according to claim 1, wherein the mounting seat (60) is arranged at an end of the fixed arm (34) far away from the pivot disk (35), and the mounting seat (60) comprises a mounting plate (61) and mounting screws (62); the mounting plate (61) is provided with a plurality of screw holes; the mounting plate (61) is fixedly connected with the fixed arm (34), and the mounting plate (61) is mounted on the wall by the mounting screws (62) passing through the plurality of screw holes.

12. A wall-mounted fly wall rack configured to be installed on a wall, comprising a rack body and a pulley assembly and counterweight mechanism (50) arranged on the rack body, wherein the rack body comprises a fixed frame (10) and at least two movable frames (20); an adjustable locking mechanism (30) is arranged between a movable frame (20) of the at least two movable frames (20) and the fixed frame (10); the adjustable locking mechanism (30) comprises a pivot arm (31) and a fixed arm (34), the movable frame (20) is connected with the pivot arm (31), and the fixed frame (10) is connected with the fixed arm (34);

wherein the pivot arm (31) is provided with a locking member (33) and a pivot shaft (32); the fixed arm (34) is provided with a pivot disk (35) and a mounting seat (60); the pivot arm (31) is rotatably connected with the pivot disk (35) through the pivot shaft (32); the pivot arm (31) horizontally rotates within a limited angle range relative to the pivot disk (35); the pivot disk (35) is provided with a plurality of fixing holes (35-1) for insertion of the locking member (33) along a rotation direction of the pivot arm (31), the pivot arm (31) is selectively positioned at one of a plurality of rotation angles through the locking member (33), and the fixed arm (34) is mounted on the wall through the mounting seat (60);

wherein the pivot arm (31) comprises a first pivot arm (31-A) and a second pivot arm (31-B) arranged up and down; the locking member (33) of the first pivot arm (31-A) and/or the second pivot arm (31-B) is an elastic locking member; the elastic locking member (33-1) comprises a shell (36), a spring (37) and a locking post (38) installed in the shell (36); the shell (36) is fixedly clamped on the pivot arm (31), and one end of the locking post (38) close to the pivot disk (35) passes through the shell (36) to be inserted into a fixing hole of the plurality of fixing holes (35-1) for locking, and one end far from the pivot disk (35) passes through the shell (36) to form a locking member handle (39);

wherein the pulley assembly comprises a handle pulley block (70), an adjusting pulley (76), a first guide pulley (77), a second guide pulley (78) and a pulley frame (79); the first guide pulley (77) is arranged at a top of the movable frame (20); the second guide pulley (78) is arranged at a top of the second pivot arm (31-B) and far away from the pivot shaft (32); and the pulley frame (79) is arranged at the top of the first pivot arm (31-A); and wherein a middle part of the second pivot arm (31-B) is provided with a lock catch (90) and a fixing rope (91); the fixing rope (91) extends from the lock catch (90) and sequentially passes through the adjusting pulley (76) and the second guide pulley (78) and is connected to the handle pulley block (7770).

13. A wall-mounted fly wall rack configured to be installed on a wall, comprising a rack body and a pulley assembly and counterweight mechanism (50) arranged on the rack body, wherein the rack body comprises a fixed frame (10) and at least two movable frames (20); an adjustable locking mechanism (30) is arranged between a movable frame (20) of the at least two movable frames (20) and the fixed frame (10); the adjustable locking mechanism (30) comprises a pivot arm (31) and a fixed arm (34), the movable frame (20) is connected with the pivot arm (31), and the fixed frame (10) is connected with the fixed arm (34);

wherein the pivot arm (31) is provided with a locking member (33) and a pivot shaft (32); the fixed arm (34) is provided with a pivot disk (35) and a mounting seat (60); the pivot arm (31) is rotatably connected with the pivot disk (35) through the pivot shaft (32); the pivot arm (31) horizontally rotates within a limited angle range relative to the pivot disk (35); the pivot disk (35) is provided with a plurality of fixing holes (35-1) for insertion of the locking member (33) along a rotation direction of the pivot arm (31), the pivot arm (31) is selectively positioned at one of a plurality of rotation angles through the locking member (33), and the fixed arm (34) is mounted on the wall through the mounting seat (60);

wherein the pivot arm (31) comprises a first pivot arm (31-A) and a second pivot arm (31-B) arranged up and down; the locking member (33) of the first pivot arm (31-A) and/or the second pivot arm (31-B) is an elastic locking member; the elastic locking member (33-1) comprises a shell (36), a spring (37) and a locking post (38) installed in the shell (36); the shell (36) is fixedly clamped on the pivot arm (31), and one end of the locking post (38) close to the pivot disk (35) passes through the shell (36) to be inserted into a fixing hole of the plurality of fixing holes (35-1) for locking, and one end far from the pivot disk (35) passes through the shell (36) to form a locking member handle (39); and wherein the counterweight mechanism (50) comprises a counterweight lever (51) and a limit member (52); the counterweight lever (51) is configured to be sleeved on the fixed frame (10) in an up-and-down slidable way, and the limit member (52) is fixedly connected to the fixed frame (10) and limits the counterweight lever (51); a buffer pad (53) is arranged at a joint position of the counterweight lever (51) and the limit member (52).

* * * * *